US008081913B2

(12) United States Patent
Oyama et al.

(10) Patent No.: US 8,081,913 B2
(45) Date of Patent: Dec. 20, 2011

(54) IMAGE FORMING APPARATUS

(75) Inventors: Hajime Oyama, Chiba (JP); Katsuhiro Echigo, Saitama (JP); Takahiro Tamiya, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 591 days.

(21) Appl. No.: 12/204,071

(22) Filed: Sep. 4, 2008

(65) Prior Publication Data

US 2009/0074482 A1 Mar. 19, 2009

(30) Foreign Application Priority Data

Sep. 18, 2007 (JP) ..... 2007-240571

(51) Int. Cl.
*G03G 15/20* (2006.01)

(52) U.S. Cl. ..... 399/313; 399/66

(58) Field of Classification Search ..... 399/66, 399/297, 302, 308, 313
See application file for complete search history.

(56) References Cited

U.S. PATENT DOCUMENTS

| | | | | |
|---|---|---|---|---|
| 6,134,415 | A * | 10/2000 | Iwakura et al. | 399/299 |
| 6,178,307 | B1 * | 1/2001 | Kimura | 399/303 |
| 6,360,073 | B1 * | 3/2002 | Eelen | 399/327 |
| 2006/0209151 | A1 * | 9/2006 | Tamiya et al. | 347/103 |
| 2007/0217832 | A1 | 9/2007 | Oyama et al. | |

FOREIGN PATENT DOCUMENTS

| | | |
|---|---|---|
| JP | 10-274892 | 10/1998 |
| JP | 3346063 | 9/2002 |
| JP | 2004-246323 | 9/2004 |
| JP | 3718045 | 9/2005 |
| JP | 2006-301577 | 11/2006 |
| JP | 2006-313194 | 11/2006 |
| JP | 2007-171784 | 7/2007 |
| JP | 2007-241164 | 9/2007 |

OTHER PUBLICATIONS

U.S. Appl. No. 12/034,275, filed Feb. 20, 2008, Hajime Oyama, et al.

* cited by examiner

*Primary Examiner* — David Gray
*Assistant Examiner* — Barnabas Fekete
(74) *Attorney, Agent, or Firm* — Oblon, Spivak, McClelland, Maier & Neustadt, L.L.P.

(57) ABSTRACT

An intermediate transfer belt and a photosensitive member form a transfer nip. An electrode is arranged close to an inner surface of the intermediate transfer belt in a portion on an upstream side of a direction of endless movement of the intermediate transfer belt with respect to a downstream-side exit of the transfer nip and on a downstream side of the direction of endless movement with respect to a position at which a transfer roller charges the intermediate transfer belt. A voltage of same polarity as the polarity of a toner is applied to the electrode, so that there is no movement of an electric charge between the electrode and the intermediate transfer belt.

17 Claims, 5 Drawing Sheets

IMAGE FORMING APPARATUS

CROSS-REFERENCE TO RELATED APPLICATIONS

The present application claims priority to and incorporates by reference the entire contents of Japanese priority document 2007-240571 filed in Japan on Sep. 18, 2007.

BACKGROUND OF THE INVENTION

1. Field of the Invention

The present invention relates to an electrophotographic image forming apparatus.

2. Description of the Related Art

In an electrophotographic image forming apparatus, a toner image formed on a surface of an image carrying member is transferred on a belt or on a sheet of recording medium conveyed on the belt. The image carrying member and the belt are arranged to adjacently face each other to form a transfer nip within which the process of image transfer is performed. However, during the process of image transfer, there is a possibility that a small amount of toner in the toner image scatters around thereby deteriorating the image quality. Such a problem is caused by occurrence of an electric discharge between the belt and the image carrying member at an exit of the transfer nip. Because of the electric discharge, the electric polarity of some of the particles in the toner is reversed thereby causing toner scattering.

Japanese Patent Application Laid-open No. 2006-301577 discloses an image forming apparatus in which an electric discharge is prevented from occurring at an exit of a transfer nip formed between an image carrying member and an intermediate transfer belt. For that, a neutralizing electrode is arranged to abut against the inner surface of the intermediate transfer belt at a position within the transfer nip that lies at a downstream side of the direction of movement of the intermediate transfer belt with respect to an abutting portion of an transfer member and the inner surface of the intermediate transfer belt, and on an upstream side of the direction of movement of the intermediate transfer belt with respect to a downstream-side exit of the transfer nip. A voltage of opposite polarity to the polarity of the toner is applied to the transfer member such that the intermediate transfer belt is charged with an electric charge of that opposite polarity. The neutralizing electrode is charged with an electric charge of the same polarity as the polarity of the toner such that the intermediate transfer belt is electrically neutralized. Thus, the difference in the electric potential between the image carrying member and the intermediate transfer belt decreases. As a result, an electric discharge is prevented from occurring at the downstream-side exit of the transfer nip. That prevents toner scattering in the toner image thereby maintaining the image quality.

However, electric neutralization of the intermediate transfer belt at the transfer nip results in poor retention of the toner on the intermediate transfer belt when the toner image passes through the transfer nip. That causes toner scattering even by a slight impact on the intermediate transfer belt thereby deteriorating the image quality.

SUMMARY OF THE INVENTION

It is an object of the present invention to at least partially solve the problems in the conventional technology.

According to an aspect of the present invention, there is provided an image forming apparatus including an image carrying member that carries a toner image formed with a toner that is charged with an electric charge of a first polarity; an endless belt that performs an endless movement around a plurality of supporting members and that abuts against the image carrying member to form a transfer nip; an electric-field generating unit that generates an electric field for transferring the toner image from the image carrying member onto either one of the endless belt and a recording medium conveyed on the endless belt in the transfer nip by charging the endless belt to a second polarity that is opposite to the first polarity while abutting or approaching close to an inner surface of the endless belt; and an electrode member that is arranged close to the inner surface of the endless belt in either one of a portion around an exit of the transfer nip on a downstream side of a direction of the endless movement of the endless belt and a portion on an upstream side of the direction of endless movement of the endless belt with respect to the exit of the transfer nip on the downstream side of the direction of endless movement of the endless belt and on the downstream side of the direction of endless movement of the endless belt with respect to a position at which the electric-field generating unit charges the endless belt, to which a voltage of same polarity as the first polarity is applied. The voltage applied to the electrode member is set such that there is no electric discharge between the electrode and the endless belt or a charge amount moved by the electric discharge is equal to or smaller than 10% of a charge amount supplied by the electric-field generating unit.

Furthermore, according to another aspect of the present invention, there is provided an image forming apparatus including an image carrying member that carries a toner image formed with a toner that is charged with an electric charge of a first polarity; an endless belt that performs an endless movement around a plurality of supporting members and that abuts against the image carrying member to form a transfer nip; an electric-field generating unit that generates an electric field for transferring the toner image from the image carrying member onto either one of the endless belt and a recording medium conveyed on the endless belt in the transfer nip by charging the endless belt to a second polarity that is opposite to the first polarity while abutting or approaching close to an inner surface of the endless belt; and an electrode member that is arranged close to the inner surface of the endless belt in either one of a portion around an exit of the transfer nip on a downstream side of a direction of the endless movement of the endless belt and a portion on an upstream side of the direction of endless movement of the endless belt with respect to the exit of the transfer nip on the downstream side of the direction of endless movement of the endless belt and on the downstream side of the direction of endless movement of the endless belt with respect to a position at which the electric-field generating unit charges the endless belt. An electric potential of the electrode has a second polarity that is opposite to the first polarity and is either one of a ground potential and smaller than an electric potential of the endless belt. The electric potential of the electrode is set such that there is no electric discharge between the electrode and the endless belt or a charge amount moved by the electric discharge is equal to or smaller than 10% of a charge amount supplied by the electric-field generating unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 1:
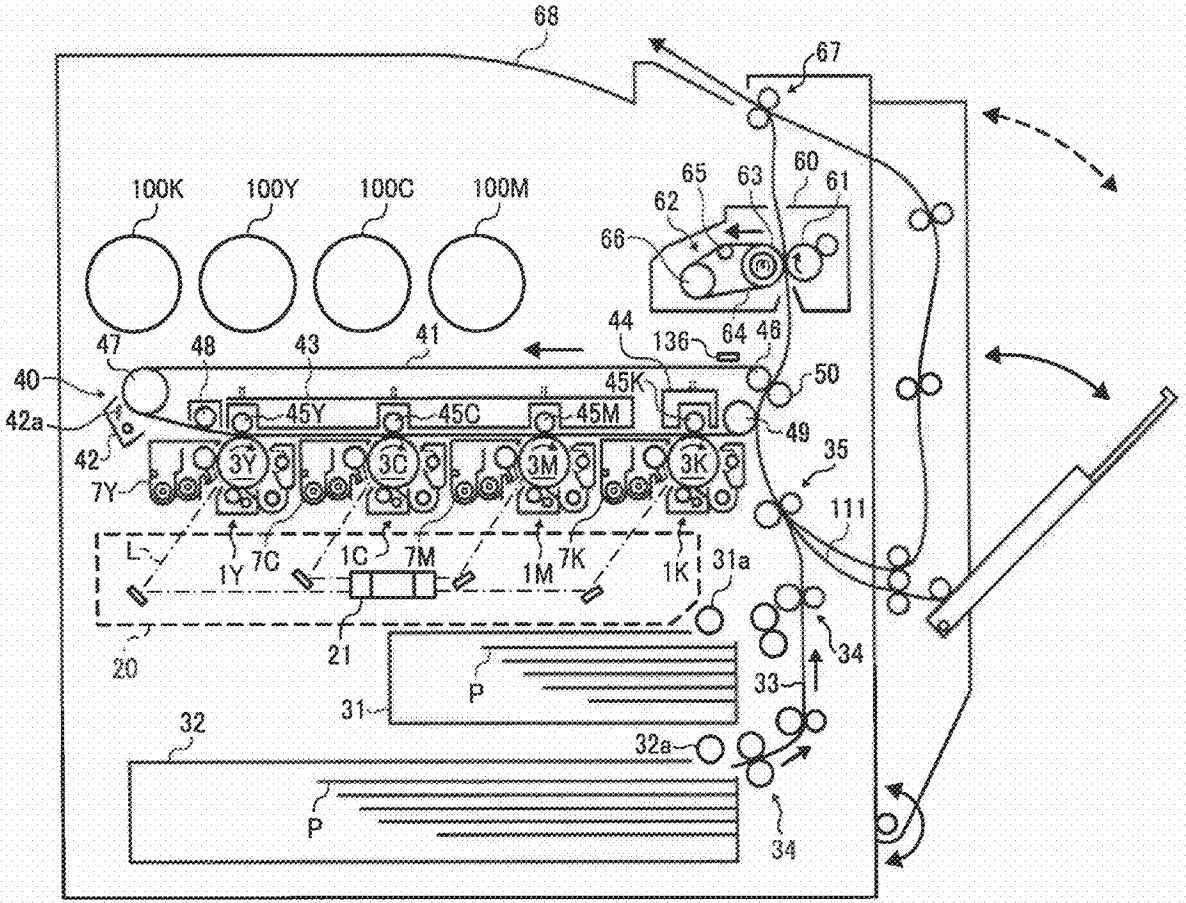
FIG. 1 is a schematic diagram of an image forming apparatus according to an embodiment of the present invention.

FIG. 1 is a schematic diagram of an electrophotographic image forming apparatus such as an electrophotographic printer according to an embodiment of the present invention.

The image forming apparatus includes four processing units 1Y, 1C, 1M, and 1K that are used to form a toner image in yellow, cyan, magenta, and black, respectively. Except for the difference in the color of toner, which is an image forming material, each of the processing units 1Y, 1C, 1M, and 1K has an identical structure.

Figure 2:
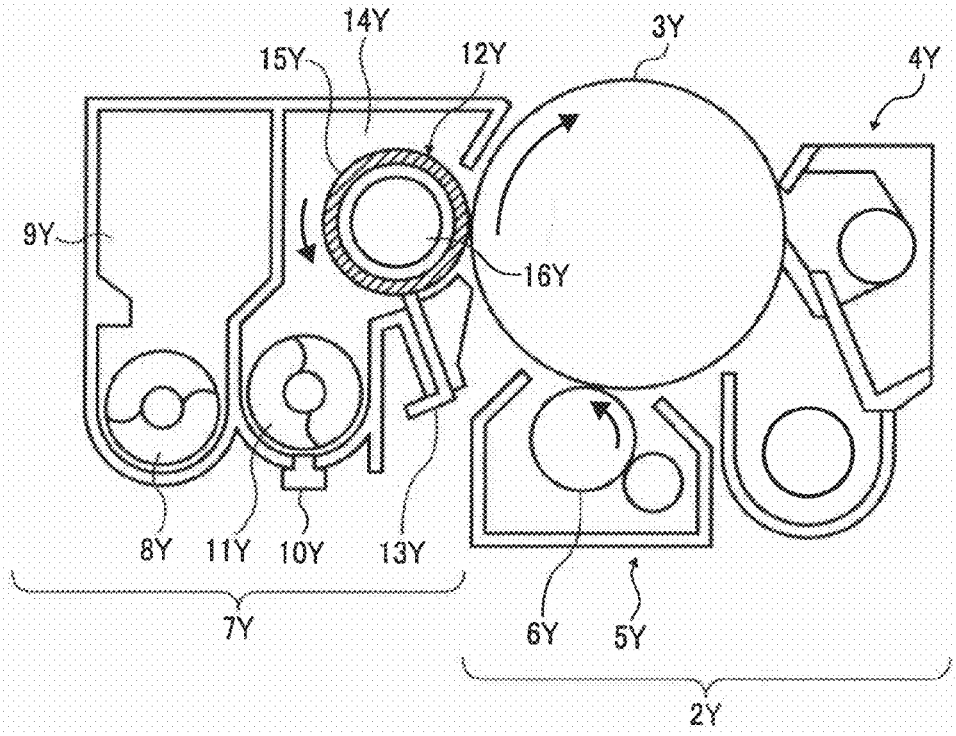
FIG. 2 is a schematic diagram of a processing unit in the image forming apparatus.

Hence, the description regarding the processing units 1Y, 1C, 1M, and 1K is given only with reference to the processing unit 1Y. FIG. 2 is a schematic diagram of the processing unit 1Y. As shown in FIG. 2, the processing unit 1Y includes a photosensitive unit 2Y and a developing unit 7Y that are arranged integratedly. The processing unit 1Y is detachably attached to the main body of the image forming apparatus. Meanwhile, upon detaching the processing unit 1Y from the main body of the image forming apparatus, the developing unit 7Y can be used in combination with another photosensitive unit.

The photosensitive unit 2Y includes a photosensitive drum 3Y that functions as an image carrying member, a drum cleaning unit 4Y, a charging unit 5Y, and a neutralizing unit (not shown).

A driving unit (not shown) is used to rotate the photosensitive drum 3Y in clockwise direction. When the photosensitive drum 3Y starts rotating, the charging unit 5Y uniformly charges the surface of the photosensitive drum 3Y with an electric charge of, although not limited to, negative polarity. More particularly, the charging unit 5Y includes a charging roller 6Y that rotates in anticlockwise direction and is arranged close to the photosensitive drum 3Y. A charge bias supply (not shown) applies a charge bias voltage to the charging roller 6Y to uniformly charge the surface of the photosensitive drum 3Y. Meanwhile, instead of using the charging roller 6Y, a charging brush can also be arranged to abut against the surface of the photosensitive drum 3Y. Moreover, a corona charging mechanism such as a scorotron charging unit or a corotron charging unit can also be used to uniformly charge the surface of the photosensitive drum 3Y. Upon being uniformly charged, the surface of the photosensitive drum 3Y is exposed to light of a light beam, which is emitted from an optical writing unit 20, and subjected to optical scanning. As a result, an electrostatic latent image is formed on the surface of the photosensitive drum 3Y.

The developing unit 7Y includes a first developer container 9Y and a second developer container 14Y. The first developer container 9Y includes a first screw conveyer 8Y; while the second developer container 14Y includes a magnetic permeability sensor 10Y, a second screw conveyer 11Y, a developing roller 12Y, and a doctor blade 13Y. The first developer container 9Y and the second developer container 14Y contain a yellow developer (not shown) that includes magnetic carrier particles and a yellow toner charged with an electric charge of, although not limited, negative polarity. A driving unit (not shown) is used to rotate the first screw conveyer 8Y such that the yellow developer in the first developer container 9Y is conveyed from the near side to the farther side. The yellow developer then enters into the second developer container 14Y via a through hole (not shown) in a partition between the first developer container 9Y and the second developer container 14Y.

A driving unit (not shown) is used to rotate the second screw conveyer 11Y such that the yellow developer in the second developer container 14Y is conveyed from the farther side to the near side. The magnetic permeability sensor 10Y is arranged at the bottom of the second developer container 14Y and is used to detect the magnetic permeability of the yellow developer for obtaining the toner concentration in the yellow developer. The developing roller 12Y is arranged in the top portion of the second developer container 14Y and has a parallel orientation to the second screw conveyer 11Y. The developing roller 12Y includes a developing sleeve 15Y that is made of a nonmagnetic insulating pipe and that rotates in the anticlockwise direction. A magnet roller 16Y inside the developing sleeve 15Y generates magnetic energy, because of which the yellow developer in the second developer container 14Y is pumped on the surface of the developing sleeve 15Y. The doctor blade 13Y is arranged at a predetermined distance from the developing sleeve 15Y such that the coat of the yellow developer on the developing sleeve 15Y is maintained at a constant thickness. The yellow developer is then conveyed to a developing area facing the photosensitive drum 3Y. The yellow toner in the yellow developer is transferred on an electrostatic latent image formed on the surface of the photosensitive drum 3Y to obtain a yellow toner image. Upon transferring the yellow toner on the photosensitive drum 3Y, the toner concentration in the yellow developer decreases. Such a yellow developer with decreased toner concentration is then returned to the second screw conveyer 11Y due to the rotation of the developing sleeve 15Y. Upon reaching the front side in the second screw conveyer 11Y, the yellow developer is re-conveyed to the first developer container 9Y via a through hole (not shown).

The magnetic permeability sensor 10Y outputs the magnetic permeability of the yellow developer to a control unit (not shown) in the form of a voltage signal. Because the magnetic permeability is correlated to the toner concentration in the yellow developer, the voltage in the voltage signal output from the magnetic permeability sensor 10Y corresponds to the toner concentration in the yellow developer. The control unit compares that voltage with a reference voltage Vtref, which is stored in a random access memory (RAM) arranged therein, and, corresponding to the amount of decrease in the toner concentration, instructs a toner supplying unit (not shown) to supply the yellow toner to the yellow developer in the first developer container 9Y. In this way, the toner concentration in the yellow developer is maintained within a predetermined range.

As shown in FIG. 1, the optical writing unit 20 is arranged beneath the processing units 1Y, 1C, 1M, and 1K. The optical writing unit 20 delivers a laser light L, which is generated by a light source (not shown) based on image information, to the uniformly charged surface of each of the photosensitive drums 3Y, 3C, 3M, and 3K. More particularly, in the optical writing unit 20, the laser light L deflects from a polygon mirror 21, which is driven by a motor (not shown), and passes through a plurality of lenses and mirrors before falling on the uniformly charged surface of each of the photosensitive drums 3Y, 3C, 3M, and 3K. Consequently, the electric potential of negative polarity of the exposed portion on the uniformly charged surface of each of the photosensitive drums 3Y, 3C, 3M, and 3K decreases from the electric potential of negative polarity of the corresponding surrounding non-exposed portion. The exposed portion functions as an image portion at which an electrostatic latent image is formed. Meanwhile, for the purpose of optically scanning the photosensitive drums 3Y, 3C, 3M, and 3K, a light emitting diode (LED) array can also be used instead of the optical writing unit 20.

Reverting to the description of the developing unit 7Y, a developing bias supply (not shown) applies a developing bias voltage of negative polarity to the developing sleeve 15Y. The developing bias voltage has an intermediate voltage value between the electric potential of negative polarity of the image portion and the electric potential of negative polarity of the non-image portion. Due to the developing bias voltage, a developing electric field is generated around the developing area between the photosensitive drum 3Y and the developing sleeve 15Y. As a result, the yellow toner in the yellow developer is electrostatically transferred from the developing sleeve 15Y on the electrostatic latent image formed on the surface of the photosensitive drum 3Y thereby forming the yellow toner image. Moreover, around a non-developing area between the non-image portion of the photosensitive drum 3Y and the developing sleeve 15Y, a non-developing electric field is generated by which any yellow toner attached to the non-image portion of the photosensitive drum 3Y is electrostatically transferred back to the developing sleeve 15Y.

The yellow toner image on the photosensitive drum 3Y is then primary-transferred on an intermediate transfer belt 41 described later. Subsequently, the drum cleaning unit 4Y removes the residual yellow toner from the photosensitive drum 3Y. The neutralizing unit then removes the electric charge from the surface of the photosensitive drum 3Y such that the photosensitive drum 3Y is reset for subsequent image formation. The primary transfer of the yellow toner image is followed by a sequential primary transfer of a cyan toner image, a magenta toner image, and a black toner image from the surface of the photosensitive drums 3C, 3M, and 3K, respectively, on the intermediate transfer belt 41.

As shown in FIG. 1, a first paper cassette 31 and a second paper cassette 32 are arranged beneath the optical writing unit 20. The first paper cassette 31 is arranged above the second paper cassette 32. A plurality of sheets P of recording paper is stacked in the first paper cassette 31 and the second paper cassette 32. A first feeding roller 31*a* abuts against the topmost sheet P of the stack in the first paper cassette 31, while a second feeding roller 32*a* abuts against the topmost sheet P of the stack in the second paper cassette 32. When a driving unit (not shown) rotates the first feeding roller 31*a* in the anticlockwise direction, the topmost sheet P in the first paper cassette 31 is fed to a sheet conveying path 33, which extends vertically on the right side of the first paper cassette 31. Similarly, when a driving unit (not shown) rotates the second feeding roller 32*a* in the anticlockwise direction, the topmost sheet P in the second paper cassette 32 is fed to the sheet conveying path 33. A plurality of pairs of conveying rollers 34 are arranged along the sheet conveying path 33. The sheet P fed from either one of the first paper cassette 31 and the second paper cassette 32 is conveyed upward to a pair of registration rollers 35 through the pairs of conveying rollers 34.

The pair of registration rollers 35 is arranged at the top end of the sheet conveying path 33. Upon reaching the pair of registration rollers 35, the conveyance of the sheet P comes to a temporary halt because of a still state of the pair of registration rollers 35. The pair of registration rollers 35 starts rotating at an appropriate timing such that the sheet P is conveyed to a secondary transfer nip described later.

An intermediate transfer unit 40 is arranged above the processing units 1Y, 1C, 1M, and 1K. The intermediate transfer unit 40 includes the intermediate transfer belt 41, which is an endless belt stretched around eight rollers, viz., four primary transfer rollers 45Y, 45C, 45M, and 45K, a secondary-transfer backup roller 46, a driving roller 47, an auxiliary roller 48, and a tension roller 49. The intermediate transfer belt 41 rotates in the anticlockwise direction along with the rotation of the driving roller 47. Meanwhile, details of the auxiliary roller 48 are not shown in FIG. 1 for the purpose of simplification.

Each of the primary transfer rollers 45Y, 45C, 45M, and 45K abuts against the inner surface of the intermediate transfer belt 41 and biases the intermediate transfer belt 41 to make contact with the corresponding photosensitive drum 3Y, 3C, 3M, or 3K. A primary transfer nip is formed at the contact portion of the intermediate transfer belt 41 and each of the photosensitive drums 3Y, 3C, 3M, and 3K. A primary transfer bias voltage of opposite polarity to the polarity of the toners in the processing units 1Y, 1C, 1M, and 1K is applied to the inner surface of the intermediate transfer belt 41. Thus, because the toners in the processing units 1Y, 1C, 1M, and 1K are charged with an electrical charge of negative polarity, the intermediate transfer belt 41 is charged with an electrical charge of positive polarity. Due to the primary transfer bias voltage, a primary-transfer electric field is generated around each primary transfer nip. When the intermediate transfer belt 41 rotates through the four primary transfer nips, then the four toner images in yellow, cyan, magenta, and black are sequentially primary-transferred on an identical portion on the outer face of the intermediate transfer belt 41. That is, the four toner images are superimposed on the outer face of the intermediate transfer belt 41 to form a four-color toner image.

A secondary transfer roller 50 and the secondary-transfer backup roller 46 sandwich the intermediate transfer belt 41 to form the secondary transfer nip. The pair of registration rollers 35 conveys the sheet P to the secondary transfer nip at the same timing when the four-color toner image formed on the intermediate transfer belt 41 reaches the secondary transfer nip.

The secondary transfer roller 50 applies a secondary transfer bias voltage of opposite polarity to the polarity of the toners in the four-color toner image to the outer face of the intermediate transfer belt 41. As a result, a secondary-transfer electric field is generated around the secondary transfer nip. When the sheet P passes through the secondary transfer nip, the four-color toner image is secondary-transferred on the sheet P because of the secondary-transfer electric field and the nip pressure of the secondary transfer nip. The four-color toner image and the white color of the sheet P combinedly form a full-color toner image on the sheet P.

When the four-color toner image is secondary-transferred on the sheet P, some amount of toner remains attached to the intermediate transfer belt 41. A belt cleaning unit 42 in the intermediate transfer unit 40 is used to remove such residual toner from the intermediate transfer belt 41. More particularly, the belt cleaning unit 42 includes a belt cleaning blade 42*a* that makes contact with the outer face of the intermediate transfer belt 41 for rubbing away the residual toner therefrom.

Meanwhile, the intermediate transfer unit 40 includes a first bracket 43 that, based on activation of a solenoid circuit (not shown), oscillates at a predetermined oscillating angle around the rotational axis of the auxiliary roller 48. When the image forming apparatus is in a single-color image formation mode, then the solenoid circuit is activated such that the first bracket 43 oscillates in the anticlockwise direction only by a small amount. That causes the primary transfer rollers 45Y, 45C, and 45M to rotate in the anticlockwise direction. As a result, the intermediate transfer belt 41 is separated from the photosensitive drums 3Y, 3C, and 3M. Subsequently, only the processing unit 1K is used to form a black toner image. In this way, during the single-color image formation mode, the processing units 1Y, 1C, and 1M are not unnecessarily activated thereby preventing wear and tear.

A fixing unit 60 is arranged above the secondary transfer nip, and includes a pressure roller 61 and a fixing belt mechanism 62. The fixing belt mechanism 62 includes a fixing belt 64, which is an endless belt, stretched around a heating roller 63, a tension roller 65, and a driving roller 66. The fixing belt 64 is rotated in the anticlockwise direction. The heating roller 63 includes a heating source (not shown) such as a halogen lamp that applies heat to the inner surface of the fixing belt 64 during an endless movement thereof. The pressure roller 61 and the heating roller 63 sandwich the fixing belt 64 to form a fixing nip.

A temperature sensor (not shown) is arranged at a predetermined distance from the outside face of the fixing belt 64. The temperature sensor detects the surface temperature of the fixing belt 64 immediately before a sheet P is conveyed to the fixing nip and outputs the detected temperature to a fixing power circuit (not shown). Based on the detected temperature, the fixing power circuit controls the power supply to the heating source in the heating roller 63 or a heating source (not shown) in the pressure roller 61 such that the surface temperature of the fixing belt 64 is maintained at about 140° C.

Upon passing through the second transfer nip, the sheet P reaches the fixing unit 60. At the fixing nip, the sheet P is subjected to heat and pressure such that the full-color toner image is fixed thereon.

The sheet P is then discharged via a pair of discharge rollers 67 to a catch tray 68, which is arranged on the top surface of a main body housing of the image forming apparatus.

Four toner cartridges 100Y, 100C, 100M, and 100K are arranged above the intermediate transfer unit 40. A fresh toner in yellow, cyan, magenta, and black is stored in the toner cartridges 100Y, 100C, 100M, and 100K, respectively. When necessary, the toner cartridges 100Y, 100C, 100M, and 100K supply the corresponding fresh toner to the developing units 7Y, 7C, 7M, and 7K, respectively. Each of the toner cartridges 100Y, 100C, 100M, and 100K is independently and detachably attached to the main body of the image forming apparatus.

Meanwhile, it is desirable to manufacture the intermediate transfer belt 41 from a non-stretchable material to prevent scaling up or scaling down of toner images formed thereon. For example, the intermediate transfer belt 41 can be made of a single-layer belt having a single-layer polyimide (PI) substrate. Instead of using polyimide, it is also possible to use known thermoplastic resins, thermoplastic elastomers, thermosetting resins, and the like. For example, it is possible to use a resin material such as vinylidene fluoride (PVDF), polyethylene tetrafluoroethylene (ETFE), polycarbonate (PC), polyester resin, polyamide resin, polyurethane resin, polyether resin, polyvinyl resin, and the like. Moreover, a composite material having a specific electric resistance can be manufactured by admixing conductive particles or a conductive powder to one of the abovementioned resin materials. Meanwhile, if the primary transfer bias voltage applied to the inner surface of the intermediate transfer belt 41 is about 1 kilovolt, then it is desirable that the volume resistivity of the intermediate transfer belt 41 is in the range of about $1\times10^{7}$ Ω·cm to about $1\times10^{13}$ Ω·cm and the surface resistance of the inner surface of the intermediate transfer belt 41 is about $1\times10^{9}$Ω/□. Moreover, to measure the electric resistance, it is desirable to use a thin and flexible electrode that has thickness in the range of about 50 micrometers to about 200 micrometers, and that includes a main electrode having outside diameter of about 5.9 millimeters and a guard electrode having inside diameter of about 11.0 millimeters and outside diameter of about 17.8 millimeters. A voltage of, although not limited to, about 500 volts is applied to the electrode and the electric resistance is measured from the value of current between the main electrode and the guard electrode.

A conductive material or a mixture of conductive materials is used to adjust the resistance of the intermediate transfer belt 41. The conductive material can be a metal powder of carbon, aluminum, or nickel; a metal oxide such as titanium oxide; a conductive high molecular compound such as quaternary ammonium salt-containing polymethyl methacrylate, polyvinyl aniline, polyvinyl pyrrole, polydiacetylene, polyethyleneimine, boron-containing high molecular compound, and polypyrrole; and the like.

The toner used in each of the processing units 1Y, 1C, 1M, and 1K can be manufactured by mixing a charge control agent (CCA) or a coloring material in a matrix resin of polyester, polyol, styrene acrylic resin, and the like. Moreover, an external additive substance such as silica or titanium oxide is added around the toner particles to improve the charging characteristic and fluidity thereof. It is desirable that the size of a particle of the external additive substance is in the range of about 0.1 micrometer to about 1.5 micrometers. The coloring material can be carbon black, phthalocyanine blue, quinacridone, carmine, and the like. Meanwhile, as described above, the toner in each of the processing units 1Y, 1C, 1M, and 1K is charged with negatively polarity.

Moreover, the toner can also be manufactured by adding an external additive substance around a matrix resin in which a substance such as wax is dispersively mixed. It is possible to use a crushing technique or a polymerization technique for manufacturing the toner. However, because the toner particles manufactured by the polymerization technique have a relatively high sphericity and circularity, it is possible to perform high quality image formation by using such toner particles.

It is desirable to use a toner that includes particles having shape factor of equal to or more than 90%. Normally, shape factor of a particle is equivalent to the sphericity thereof. The sphericity of a particle can be expressed as "surface area of a sphere having identical volume as the particle/actual surface area of the particle×100%". However, because it is difficult to measure the sphericity, the shape factor of a particle is obtained in the form of the circularity. The circularity of a particle can be expressed as "circumference of a sphere having identical projected area as the particle/length of actual projected contour of the particle×100%". As a projected image of a toner particle approaches a perfect circle, the solution of the circularity approaches 100%. Meanwhile, it is desirable that the volume mean diameter of a toner particle is in a range of about 3 micrometers to about 12 micrometers. It is assumed that the toner particles in the image forming apparatus shown in FIG. 1 have the volume mean diameter of, although not limited to, 6 micrometers. That enables image formation at a resolution of equal to or more than 1200 dots per inch (dpi).

The magnetic carrier particles used in each of the developing units 7Y, 7C, 7M, and 7K are made of, e.g., a metal core or a resin core that contains a magnetic material such as ferrite. The surface layer of each magnetic carrier particle is covered with, e.g., silicon resin. It is desirable that the size of the magnetic carrier particles is in the range of about 20 micrometers to about 50 micrometers, while the dynamic resistance of the magnetic carrier particles is in the range of about $10^4$ ohms to about $10^6$ ohms. The dynamic resistance can be measured in the following manner. First, the magnetic carrier particles are carried by using a magnetic roller that has, e.g., diameter of 20 millimeters and rotating speed of 600 revolutions per minute (RPM). Then, an electrode of 65 millimeters in width and 1 millimeter in length is arranged opposite to the magnetic particles at a gap of 0.9 millimeter. A voltage corresponding to an upper limit of a withstand pressure (e.g., voltage of about 400 volts for high-resistance silicon-coated carriers or voltage of several volts for iron powder carriers) is applied to the electrode. The dynamic resistance of the magnetic carrier particles is measured based on the value of current flowing through the electrode.

Figure 3:
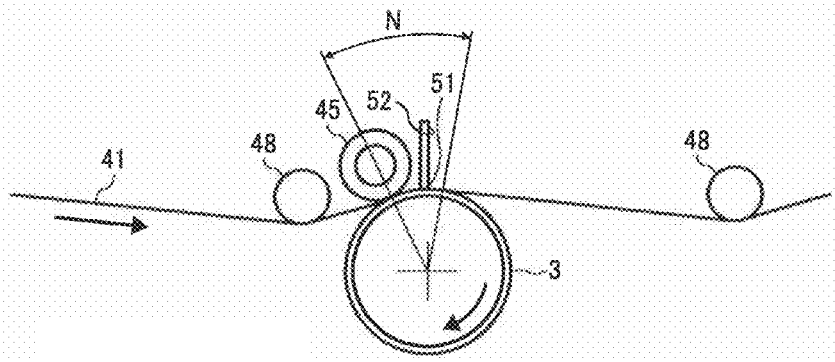
FIG. 3 is a schematic diagram for explaining an exemplary configuration of an intermediate transfer unit around a primary transfer nip.

FIG. 3 is a schematic diagram for explaining an exemplary configuration of the intermediate transfer unit 40 around a primary transfer nip N, which is formed at the contact portion of the intermediate transfer belt 41 and each of the photosensitive drums 3Y, 3C, 3M, and 3K. Because the configuration around each primary transfer nip N is identical, the letters 'Y', 'C', 'M', and 'K' indicting the toner color are omitted from the reference numerals in the following description.

At a primary transfer nip N, the intermediate transfer belt 41 and the photosensitive drum 3 rotate in the same direction at about the same speed. A transfer bias supply (not shown) applies a primary transfer bias voltage of positive polarity, which is opposite to the polarity of the toner in the processing unit 1, to the primary transfer roller 45. Consequently, the intermediate transfer belt 41 gets charged with positive polarity. The primary transfer bias voltage can be in the range of about 0.8 kilovolts to about 2 kilovolts. Due to the primary transfer bias voltage, a primary-transfer electric field is generated around the primary transfer nip N. As a result, a toner image formed on the photosensitive drum 3 is electrostatically transferred on the outer face of the intermediate transfer belt 41.

A wire-like separating electrode 51 is arranged close to the inner surface of the intermediate transfer belt 41 within a portion that lies in an upstream side of the direction of endless movement of the intermediate transfer belt 41 (hereinafter, "upstream side") with respect to an exit of the primary transfer nip N at a downstream side of the direction of endless movement of the intermediate transfer belt 41 (hereinafter, "downstream-side exit of the primary transfer nip N") and on the downstream side of the direction of endless movement of the intermediate transfer belt 41 (hereinafter, "downstream side") with respect to the abutting portion of the primary transfer roller 45 and the intermediate transfer belt 41. In the example shown in FIG. 3, the wire-like separating electrode 51 is arranged within a portion of about 1 millimeter on the upstream side of the downstream-side exit of the primary transfer nip N.

If the distance between the wire-like separating electrode 51 and the downstream-side exit of the primary transfer nip N increases, then it becomes difficult to reduce the surface potential of the portion on the outside face of the intermediate transfer belt 41 that borders the downstream-side exit of the primary transfer nip N (hereinafter, "downstream-side exit bordering portion of the intermediate transfer belt 41"). Thus, a downstream-side border of the portion of the primary transfer nip N, within which the wire-like separating electrode 51 is arranged, is determined such that it is possible to reduce the surface potential of the downstream-side exit bordering portion of the intermediate transfer belt 41. In the example shown in FIG. 3, if the downstream-side border of the portion of the primary transfer nip N, within which the wire-like separating electrode 51 is arranged, is at about 200 micrometers on the downstream side of the downstream-side exit of the primary transfer nip N, then the surface potential of the downstream-side exit bordering portion of the intermediate transfer belt 41 can be efficiently reduced.

The wire-like separating electrode 51 can be manufactured from a metal wire of, e.g., stainless used steel (SUS) or tungsten. It is desirable that the wire-like separating electrode 51 is flexible in nature and has diameter less than or equal to about 200 micrometers or, more preferably, diameter in the range of about 40 micrometers to about 100 micrometers. To maintain the wire-like separating electrode 51 along the axial direction of the photosensitive drum 3, tension is applied to at least one end thereof by using, e.g., a spring. Moreover, to prevent electric discharge between the wire-like separating electrode 51 and the primary transfer roller 45, an insulating member 52 made of a resin material is arranged therebetween.

The wire-like separating electrode 51 is arranged such that at least some of the electric charge of positive polarity on the intermediate transfer belt 41 is transferred to the inner surface thereof in an electrostatic manner. For that, the wire-like separating electrode 51 is charged either to an electric potential of negative polarity, or to an electric potential of positive polarity having smaller value than the electric potential of the intermediate transfer belt 41, or to a ground potential. More particularly, it is desirable that the electric potential of the wire-like separating electrode 51 is in the range of about +500 volts to about −500 volts such that the electrostatically inducible electric charge of positive polarity from among the electric charge on the intermediate transfer belt 41 can be transferred to the inner surface thereof. Consequently, the surface potential of the downstream-side exit bordering portion of the intermediate transfer belt 41 decreases. As a result, an electric discharge is prevented from occurring between the outside face of the intermediate transfer belt 41 and the surface of the photosensitive drum 3.

To enable electrostatic transfer of most of the electric charge of positive polarity on the intermediate transfer belt 41 to the inner surface thereof, it is desirable to apply a voltage of negative polarity to the wire-like separating electrode 51. That results in efficient reduction of the surface potential of the downstream-side exit bordering portion of the intermediate transfer belt 41 and prevents an electric discharge from occurring between the outside face of the intermediate transfer belt 41 and the surface of the photosensitive drum 3.

However, if a large voltage of negative polarity is applied to the wire-like separating electrode 51, then there is a possibility of reverse transfer of toner to the photosensitive drum 3 thereby causing the toner transfer efficiency to deteriorate. Such a problem occurs because the wire-like separating electrode 51 is arranged close to the inner surface of the intermediate transfer belt 41 within the primary transfer nip N. In the example shown in FIG. 3, the electric potential of negative polarity of the image portion on the surface of the photosensitive drum 3 is assumed to be in the range of about −50 volts to about −300 volts. In that case, if a voltage of negative polarity exceeding that range is applied to the wire-like separating electrode 51, then there is a possibility of reverse transfer of toner to the photosensitive drum 3 due to generation of a negative electric field. That results in deterioration of the toner transfer efficiency. Thus, it is desirable to adjust the voltage applied to the wire-like separating electrode 51 such that the electric potential thereof is smaller than the electric potential of the image portion on the surface of the photosensitive drum 3. In the example shown in FIG. 3, it is desirable that the voltage applied to the wire-like separating electrode 51 is in the range of about +500 volts to about −50 volts.

Meanwhile, there is almost a zero electric current between the wire-like separating electrode 51 and a bias supply (not shown), which applies voltage to the wire-like separating electrode 51. That is, the absolute value of electric current between the wire-like separating electrode 51 and the bias supply is not more than 10% of a primary transfer electric current from the intermediate transfer belt 41 to the photosensitive drum 3. As a result, there is hardly any neutralization of the electric charge of positive polarity on the intermediate transfer belt 41. Thus, without neutralizing the electric charge of positive polarity on the intermediate transfer belt 41, it is possible to prevent an electric discharge from occurring between the outside face of the intermediate transfer belt 41 and the surface of the photosensitive drum 3 at the downstream-side exit of the primary transfer nip N.

When image formation was performed in the image forming apparatus by implementing the configuration of the intermediate transfer unit 40 as shown in FIG. 3, it was confirmed that toner scattering did not occur in the toner image fixed on the sheet P. That is, a high quality image was obtained without deterioration in the toner transfer efficiency.

To determine the voltage to be applied to the wire-like separating electrode 51, it is necessary to take into consideration the voltage range within which there is no substantial neutralization of the electric charge of positive polarity on the intermediate transfer belt 41 as well as the distance between the wire-like separating electrode 51 and the intermediate transfer belt 41. Generally, shorter the distance between the wire-like separating electrode 51 and the intermediate transfer belt 41, more amount of electric potential of the intermediate transfer belt 41 is transferred to the inner surface thereof. Thus, arranging the wire-like separating electrode 51 close to the intermediate transfer belt 41 is an effective way of preventing an electric discharge from occurring between the outside face of the intermediate transfer belt 41 and the surface of the photosensitive drum 3. However, depending on the voltage applied to the wire-like separating electrode 51, arranging the wire-like separating electrode 51 too close to the intermediate transfer belt 41 may cause electric discharge between the outside face of the intermediate transfer belt 41 and the surface of the photosensitive drum 3. In that case, the electric charge of positive polarity on the intermediate transfer belt 41 gets substantially neutralized. To avoid such a problem, in the example shown in FIG. 3, the distance between the wire-like separating electrode 51 and the intermediate transfer belt 41 is set in the range of about several tens of micrometers to about 5 millimeters. By implementing such a configuration, it was confirmed that the electric charge of positive polarity on the intermediate transfer belt 41 is not substantially neutralized thereby preventing the toner transfer efficiency from deteriorating.

Figure 4:
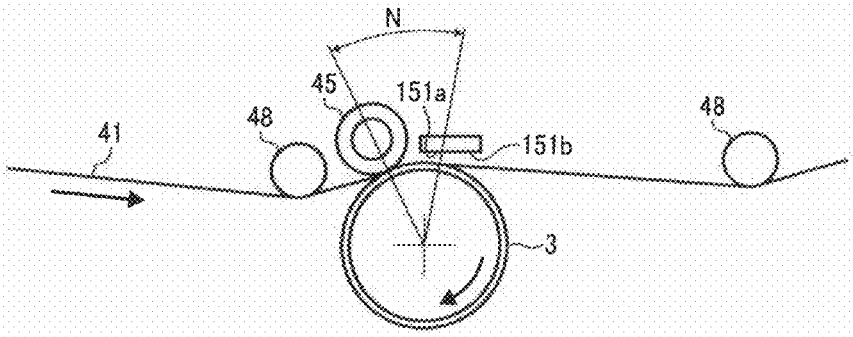
FIG. 4 is a schematic diagram for explaining another exemplary configuration of an intermediate transfer unit around a primary transfer nip.

FIG. 4 is a schematic diagram for explaining another exemplary configuration of the intermediate transfer unit 40 around the primary transfer nip N.

As shown in FIG. 4, two wire-like separating electrodes 151*a* and 151*b* are arranged close to the inner surface of the intermediate transfer belt 41. The wire-like separating electrode 151*a* is arranged at a position identical to the position of the wire-like separating electrode 51 shown in FIG. 3. That is, the wire-like separating electrode 151*a* is arranged within a portion of about 1 millimeter on the upstream side of the downstream-side exit of the primary transfer nip N. Thus, the wire-like separating electrode 151*a* functions in an identical manner to the wire-like separating electrode 51. On the other hand, the wire-like separating electrode 151*b* is arranged on the downstream side of the downstream-side exit of the primary transfer nip N. In this way, the wire-like separating electrodes 151*a* and 151*b* are arranged on the opposite sides of the downstream-side exit of the primary transfer nip N. The distance between the intermediate transfer belt 41 and each of the wire-like separating electrodes 115*a* and 151*b* is set in the range of about several tens of micrometers to about 5 millimeters. That prevents an electric discharge from occurring between the outside face of the intermediate transfer belt 41 and the surface of the photosensitive drum 3 at the downstream-side exit of the primary transfer nip N.

If a large voltage of negative polarity that exceeds the electric potential of negative polarity of the image portion on the surface of the photosensitive drum 3 is applied to the wire-like separating electrode 151*a*, then there is a possibility of reverse transfer of toner to the photosensitive drum 3 because the wire-like separating electrode 151*a* is arranged within the primary transfer nip N. However, in the case of the wire-like separating electrode 151*b*, the possibility of reverse transfer of toner is not of substantial concern because the wire-like separating electrode 151*b* is arranged outside the primary transfer nip N. Hence, by applying to the wire-like separating electrode 151*b* a large voltage of negative polarity that exceeds the electric potential of negative polarity of the image portion, it is possible to further prevent an electric discharge from occurring between the outside face of the intermediate transfer belt 41 and the surface of the photosensitive drum 3. In that case, it is desirable to apply a voltage in the range of about +800 volts to about 0 volts to the wire-like separating electrode 151*b*.

Due to such a configuration, without neutralizing the electric charge of positive polarity on the intermediate transfer belt 41, it is possible to prevent an electric discharge from occurring between the outside face of the intermediate transfer belt 41 and the surface of the photosensitive drum 3 at the downstream-side exit of the primary transfer nip N. That prevents the toner transfer efficiency from deteriorating. Meanwhile, hereinafter, the wire-like separating electrodes 151*a* and 151*b* are sometimes combinedly referred to as a wire-like separating electrode 151 for the purpose of generalization.

Figure 5:
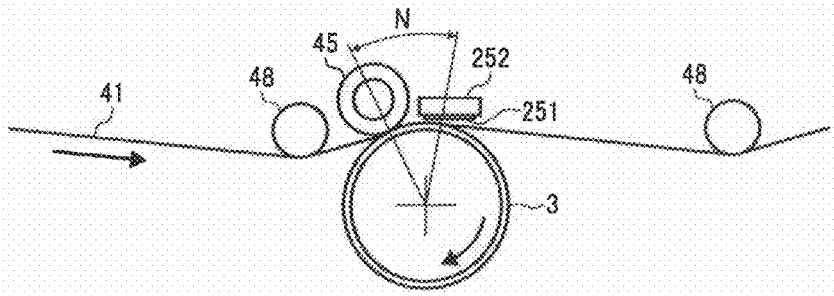
FIG. 5 is a schematic diagram for explaining still another exemplary configuration of an intermediate transfer unit around a primary transfer nip.

FIG. 5 is a schematic diagram for explaining still another exemplary configuration of the intermediate transfer unit 40 around the primary transfer nip N.

As shown in FIG. 5, a plate-like separating electrode 251 is arranged close to the inner surface of the intermediate transfer belt 41. The longitudinal plane of the plate-like separating electrode 251 lies parallel to the inner surface of the intermediate transfer belt 41 and across the downstream-side exit of the primary transfer nip N. The plate-like separating electrode 251 is fabricated on an insulating base 252.

Thus, compared to the configuration described with reference to FIG. 4, arranging only the plate-like separating electrode 251 enables to prevent an electric discharge from occurring between the outside face of the intermediate transfer belt 41 and the surface of the photosensitive drum 3 at the downstream-side exit of the primary transfer nip N at a lower manufacturing cost.

It is possible to manufacture an extremely thin plate-like separating electrode 251 by fabricating a resin-coated metal film on a plate-like insulating material. Such a plate-like separating electrode 251 enables to save space along the thickness direction of the intermediate transfer belt 41.

On the other hand, if a steel plate is used to manufacture the plate-like separating electrode 251, then there is lesser need to depend on the insulating base 252 for maintaining a precise gap between the plate-like separating electrode 251 and the intermediate transfer belt 41. As a result, a much thinner insulating base 252 can be used thereby saving the overall space along the thickness direction of the intermediate transfer belt 41.

Figure 6:
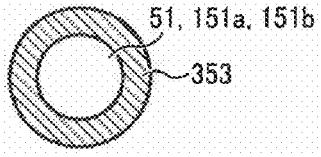
FIG. 6 is a diagram for explaining an exemplary structure of a wire-like separating electrode.
Figure 7:
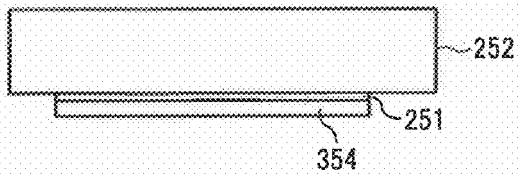
FIG. 7 is a diagram of for explaining an exemplary structure of a plate-like separating electrode.

FIG. 6 is a diagram for explaining an exemplary structure of the wire-like separating electrodes 51 and 151 that is useful in preventing charge leakage. FIG. 7 is a diagram of for explaining an exemplary structure of the plate-like separating electrode 251 that is useful in preventing charge leakage.

When a separating electrode (51, 151, or 251) is arranged close the inner surface of the intermediate transfer belt 41, an electrically conductive surface of the separating electrode is exposed open to the inner surface of the intermediate transfer belt 41. In such a configuration, there is always a possibility of charge leakage as soon as the inner surface of the intermediate transfer belt 41 makes contact with the electrically conductive surface of the separating electrode due to vibrations and the like. On the other hand, if the separating electrode is arranged distantly from the inner surface of the intermediate transfer belt 41 to prevent charge leakage due to contact, then it becomes difficult to transfer the electric charge of positive polarity on the intermediate transfer belt 41 to the inner surface thereof. Consequently, an electric discharge is not efficiently prevented from occurring between the outside face of the intermediate transfer belt 41 and the surface of the photosensitive drum 3 at the downstream-side exit of the primary transfer nip N. Taking into consideration such problems, the electrically conductive surface of the separating electrode that is exposed open to the inner surface of the intermediate transfer belt 41 is covered with a high-resistance material or, more preferably, a dielectric material having volume resistivity of equal to or more than $1\times10^{10}$ Ω·cm.

More particularly, in the case of a wire-like separating electrode (51, 151*a*, or 151*b*) made of a metal wire, the electrically conductive surface exposed open to the inner surface of the intermediate transfer belt 41 is covered by a thin layer 353 made of resin or glass. The thin layer 353 has thickness in the range of about several tens of micrometers to about several hundreds of micrometers.

In the case of the plate-like separating electrode 251, the electrically conductive surface exposed open to the inner surface of the intermediate transfer belt 41 is covered by an insulating layer 354 that is made of an insulating foam resin, an insulating short fiber brush, and the like.

It is desirable that the insulating layer 354 is elastic in nature such that slight contact between the inner surface of the intermediate transfer belt 41 and the insulating layer 354 do not affect the endless movement of the intermediate transfer belt 41.

In this way, by covering the electrically conductive surface of the separating electrode (51, 151, or 251), which is exposed open to the inner surface of the intermediate transfer belt 41, with an insulating member, charge leakage is prevented from occurring even if the inner surface of the intermediate transfer belt 41 makes contact with the insulating member. That enables to further approximate the separating electrode (51, 151, or 251) to the inner surface of the intermediate transfer belt 41. As a result, an electric discharge can be efficiently prevented from occurring between the outside face of the intermediate transfer belt 41 and the surface of the photosensitive drum 3 at the downstream-side exit of the primary transfer nip N.

Figure 8:
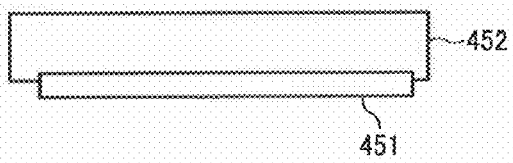
FIGS. 8 to 10 are diagrams for explaining other exemplary types of plate-like separating electrodes.
Figure 9:
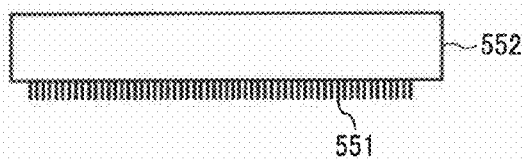
Figure 10:
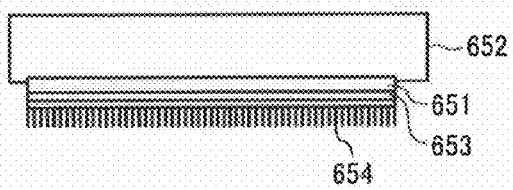

FIGS. 8 to 10 are diagrams for explaining other exemplary types of a plate-like separating electrode.

A plate-like separating electrode 451 shown in FIG. 8 is manufactured by attaching an electrically conductive fabric to an insulating base 452.

A plate-like separating electrode 551 shown in FIG. 9 is manufactured by attaching an electrically conductive brush to an insulating base 552.

When the inner surface of the intermediate transfer belt 41 makes contact with any one of the plate-like separating electrodes 451 and 551, then a friction therebetween causes a small dent in the plate-like separating electrode 451 or the plate-like separating electrode 551. However, if the dent is not more than about few hundred micrometers, then there is no considerable effect on the endless movement of the intermediate transfer belt 41.

In FIG. 10, a plate-like separating electrode 651 is fabricated on an insulating base 652 and an insulating brush 654 is attached to the plate-like separating electrode 651 by using an adhesive 653. If the inner surface of the intermediate transfer belt 41 makes contact with the plate-like separating electrode 651, then a friction therebetween causes a small dent in the plate-like separating electrode 651. However, if the dent is not more than about few hundred micrometers, then there is no considerable effect on the endless movement of the intermediate transfer belt 41. Moreover, by covering the electrically conductive surface of the plate-like separating electrode 651 by the insulating brush 654, the inner surface of the intermediate transfer belt 41 and the plate-like separating electrode 651 do not come in direct contact. That prevents problems such as insufficient toner transfer due to charge leakage.

Figure 11:
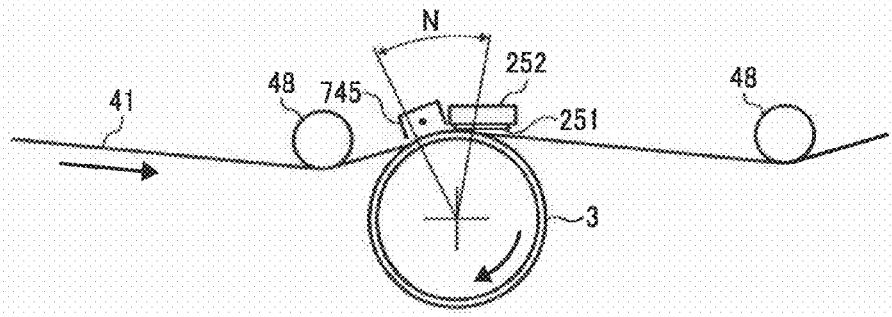
FIG. 11 is a schematic diagram for explaining an exemplary configuration of the intermediate transfer unit around the primary transfer nip when a corotron charging unit is used instead of a primary transfer roller.

FIG. 11 is a schematic diagram for explaining an exemplary configuration of the intermediate transfer unit 40 around the primary transfer nip N when a corotron charging unit 745 is used instead of the primary transfer roller 45.

Figure 12:
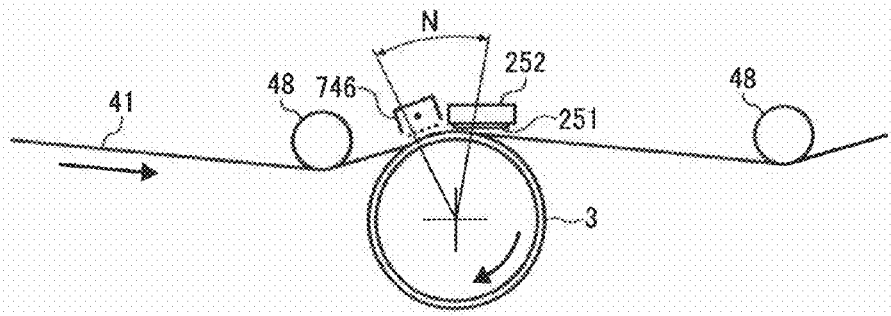
FIG. 12 is a schematic diagram for explaining an exemplary configuration of the intermediate transfer unit around the primary transfer nip when a scorotron charging unit is used instead of the primary transfer roller.

FIG. 12 is a schematic diagram for explaining an exemplary configuration of the intermediate transfer unit 40 around the primary transfer nip N when a scorotron charging unit 746 is used instead of the primary transfer roller 45.

Figure 13:
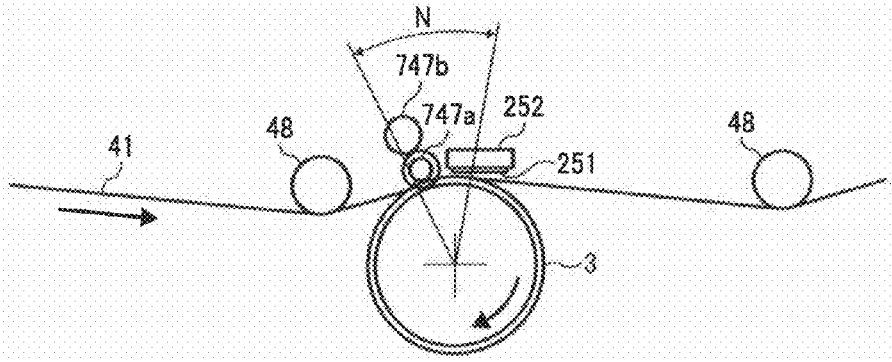
FIG. 13 is a schematic diagram for explaining an exemplary configuration of the intermediate transfer unit around the primary transfer nip when a primary transfer roller and a pressure roller are used in combination instead of the primary transfer roller.

FIG. 13 is a schematic diagram for explaining an exemplary configuration of the intermediate transfer unit 40 around the primary transfer nip N when a primary transfer roller 747*a* and a pressure roller 747*b* are used in combination instead of the primary transfer roller 45.

In the examples shown in FIGS. 11, 12, and 13, the plate-like separating electrode 251 is used as a separating electrode.

The corotron charging unit 745 or the scorotron charging unit 746 is arranged as a non-contact corona charging mechanism. Such a configuration enables to reduce the nip pressure in the primary transfer nip N thereby efficiently preventing generation of hollow images.

The scorotron charging unit 746 includes a grid electrode (not shown), which can be integratedly arranged with a shield case (not shown). If the grid electrode is configured to have a small opening of equal to or less than 2 millimeters along the direction of endless movement of the intermediate transfer belt 41, then only a small part of equal to or less than 2 millimeters in the downstream-side exit bordering portion of the intermediate transfer belt 41 can be subjected to corona charging. Such a configuration enables to arrange the plate-like separating electrode 251 close to the inner surface of the intermediate transfer belt 41 within the small corona-charged part in the downstream-side exit bordering portion of the intermediate transfer belt 41.

Regarding the configuration shown in FIG. 13, the pressure roller 747*b* abuts against the primary transfer roller 747*a* over a portion that lies along the axial direction of the primary transfer roller 747*a* and opposite to an abutting portion of the primary transfer roller 747*a* and the intermediate transfer belt 41. Because of the pressure roller 747*b*, the primary transfer roller 747*a* need not withstand the external pressure from the intermediate transfer belt 41 on its own, which could lead to deformation thereof. In other words, because the pressure roller 747*b* absorbs the external pressure from the intermediate transfer belt 41, it is possible to reduce the diameter of the primary transfer roller 747*a*. Thus, the primary transfer roller 747*a* can be configured to have a smaller diameter than the primary transfer roller 45. Consequently, less area is required to arrange the primary transfer roller 747*a* within the primary transfer nip N. That in turn facilitates in arranging the plate-like separating electrode 251 within the downstream-side exit bordering portion of the intermediate transfer belt 41. Moreover, the primary transfer roller 747*a* having a smaller diameter can also be arranged when a small photosensitive member having diameter of equal to or less than 40 millimeters is used. In the example shown in FIG. 13, the primary transfer roller 747*a* can be configured to have a small diameter in the range of about 4 millimeters to about 10 millimeters.

Thus, to sum up, a toner image is formed on the surface of the photosensitive drum 3, which functions as the image carrying member. The toner in the toner image is charged with an electric charge of a predetermined polarity (e.g., negative polarity). The intermediate transfer belt 41 is an endless belt stretched around the primary transfer roller 45, the secondary-transfer backup roller 46, the driving roller 47, the auxiliary roller 48, and the tension roller 49. The primary transfer nip N is formed at the contact portion of the intermediate transfer belt 41 and the photosensitive drum 3. The transfer power supply applies the primary transfer bias voltage of positive polarity, which is opposite to the polarity of the toner, to the primary transfer roller 45. Consequently, the intermediate transfer belt 41 gets charged with positive polarity. The separating electrode (51, 151, 251, 451, 551, or 651) is arranged close to the inner surface of the intermediate transfer belt 41 within a portion that lies in the upstream side of the downstream-side exit of the primary transfer nip N and on the downstream side of the abutting portion of the primary transfer roller 45 and the intermediate transfer belt 41. The separating electrode (51, 151, 251, 451, 551, or 651) is charged with an electric charge of the same polarity as the polarity of the toner (i.e., negative polarity). Because of such a configuration, there is hardly any neutralization of the electric charge of positive polarity on the intermediate transfer belt 41. Thus, without neutralizing the electric charge of positive polarity on the intermediate transfer belt 41, it is possible to prevent an electric discharge from occurring between the outside face of the intermediate transfer belt 41 and the surface of the photosensitive drum 3 at the downstream-side exit of the primary transfer nip N. As a result, toner scattering is prevented from occurring and a high quality image is obtained without deterioration in the toner transfer efficiency.

If the downstream-side border of the portion of the primary transfer nip N, within which the separating electrode (51, 151, 251, 451, 551, or 651) is arranged, is at about 200 micrometers on the downstream side of the downstream-side exit of the primary transfer nip N, then the surface potential of the downstream-side exit bordering portion of the intermediate transfer belt 41 can be efficiently reduced.

The charging unit 5 uniformly charges the surface of the photosensitive drum 3 to a predetermined electric potential of the same polarity as that of the toner (i.e., negative polarity). The electric potential of the separating electrode (51, 151, 251, 451, 551, or 651) is maintained smaller than the surface potential of the photosensitive drum 3. That prevents reverse transfer of toner to the photosensitive drum 3.

As shown in FIG. 4, the wire-like separating electrode 151*a* is arranged on the upstream side of the downstream-side exit of the primary transfer nip N, while the wire-like separating electrode 151*b* is arranged on the downstream side of the downstream-side exit of the primary transfer nip N. Such a configuration efficiently prevents an electric discharge from occurring between the outside face of the intermediate transfer belt 41 and the surface of the photosensitive drum 3 at the downstream-side exit of the primary transfer nip N.

As described above, the wire-like separating electrode (51, 151*a*, or 151*b*) is a substantially circular electrode made of a metal wire having a cross-sectional diameter of equal to or less than 200 micrometers. Moreover, the wire-like separating electrode (51, 151*a*, or 151*b*) is arranged perpendicular to the direction of endless movement of the intermediate transfer belt 41. Thus, it is possible to arrange the wire-like separating electrode (51, 151*a*, and 151*b*) close to the inner surface of the intermediate transfer belt 41 within the downstream-side exit bordering portion of the intermediate transfer belt 41, which is very small in size.

As shown in FIG. 5, the plate-like separating electrode 251 is arranged close to the inner surface of the intermediate transfer belt 41 such that the longitudinal plane of the plate-like separating electrode 251 lies parallel to the inner surface of the intermediate transfer belt 41 and across the downstream-side exit of the primary transfer nip N. Such a configuration enables to efficiently reduce the surface potential of the downstream-side exit bordering portion of the intermediate transfer belt 41 at a lower manufacturing cost. Moreover, when a steel plate is used to manufacture the plate-like separating electrode 251, it is possible to save the overall space along the thickness direction of the intermediate transfer belt 41.

Meanwhile, the space along the thickness direction of the intermediate transfer belt 41 can also be saved if the plate-like separating electrode 251 is manufactured by fabricating a resin-coated metal film on a plate-like insulating material.

As shown in FIG. 8, the plate-like separating electrode 451 is manufactured by attaching an electrically conductive fabric to the insulating base 452. Due to such a configuration, the endless movement of the intermediate transfer belt 41 is not affected even if the intermediate transfer belt 41 makes a slight contact with the plate-like separating electrode 451.

As shown in FIGS. 9 and 10, because each of the plate-like separating electrodes 551 and 651 has a brush structure, the endless movement of the intermediate transfer belt 41 is not affected even if the intermediate transfer belt 41 makes a slight contact with the brush structure.

Moreover, because the electrically conductive surface of the separating electrode (51, 151, or 251), which is exposed open to the inner surface of the intermediate transfer belt 41, is made of a high-resistance material having volume resistivity of equal to or more than $1\times10^{10}$ Ω·cm, it is possible to prevent charge leakage from occurring even if the inner surface of the intermediate transfer belt 41 makes contact with the separating electrode. That enables to further approximate the separating electrode (51, 151, or 251) to the inner surface of the intermediate transfer belt 41. As a result, an electric discharge can be efficiently prevented from occurring between the outside face of the intermediate transfer belt 41 and the surface of the photosensitive drum 3 at the downstream-side exit of the primary transfer nip N.

Furthermore, by using the corotron charging unit 745 or the scorotron charging unit 746 instead of the primary transfer roller 45, it is possible to reduce the nip pressure in the primary transfer nip N thereby efficiently preventing generation of hollow images.

Particularly, by using the scorotron charging unit 746, it is possible to arrange the separating electrode (51, 151, 251, 451, 551, or 651) close to the inner surface of the intermediate transfer belt 41 within the small corona-charged part in the downstream-side exit bordering portion of the intermediate transfer belt 41.

As shown in FIG. 13, the pressure roller 747*b* abuts against the primary transfer roller 747*a* over a portion that lies along the axial direction of the primary transfer roller 747*a* and opposite to the abutting portion of the primary transfer roller 747*a* and the intermediate transfer belt 41. Such a configuration enables to arrange the separating electrode (51, 151, 251, 451, 551, or 651) close to the inner surface of the intermediate transfer belt 41 within the downstream-side exit bordering portion of the intermediate transfer belt 41.

Meanwhile, even if the separating electrode (51, 151, 251, 451, 551, or 651) is charged either to a ground potential or to an electric potential that has opposite polarity to the polarity of the toner and a smaller value than the electric potential of the intermediate transfer belt 41, it is possible to prevent an electric discharge from occurring between the outside face of the intermediate transfer belt 41 and the surface of the photosensitive drum 3 at the downstream-side exit of the primary transfer nip N without neutralizing the electric charge of positive polarity on the intermediate transfer belt 41. As a result, toner scattering is prevented from occurring and a high quality image is obtained without deterioration in the toner transfer efficiency.

In the above description, the transfer bias supply is used to maintain the primary transfer electric current from the intermediate transfer belt 41 to the photosensitive drum 3 at a constant value (i.e., constant current control). However, it is also possible to use a transfer bias supply that performs a constant voltage control.

Moreover, instead of a primary transfer nip, the above description is also applicable to a secondary transfer nip.

Furthermore, the above description is applicable to each of a single-color image formation mode, a two-color image forming mode, a three-color image forming mode, and a full-color toner image.

Moreover, instead of an intermediate transfer mechanism, the above description is also applicable to a direct transfer mechanism, in which a toner image is transferred from a photosensitive drum directly on a sheet of recording medium conveyed on a conveying belt.

Thus, according to an aspect of the present invention, a separating electrode is arranged such that at least some of an electric charge on an intermediate transfer belt is transferred to the inner surface thereof in an electrostatic manner. That enables to reduce the surface potential of a portion on the outside face of the intermediate transfer belt that borders the downstream-side exit of a primary transfer nip. As a result, an electric discharge is prevented from occurring between the outside face of the intermediate transfer belt and the surface of an image carrying member.

Moreover, prevention of the electric discharge without neutralizing the electric charge of the intermediate transfer belt results in excellent retention of toner on the intermediate transfer belt when a toner image passes through the transfer nip. As a result, toner scattering is prevented from occurring and a high quality image is obtained without deterioration in the toner transfer efficiency.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrying member that carries a toner image formed with a toner that is charged with an electric charge of a first polarity;

an endless belt that performs an endless movement around a plurality of supporting members and that abuts against the image carrying member to form a transfer nip;

an electric-field generating unit that generates an electric field for transferring the toner image from the image carrying member onto either one of the endless belt and a recording medium conveyed on the endless belt in the transfer nip by charging the endless belt to a second polarity that is opposite to the first polarity while abutting or approaching close to an inner surface of the endless belt; and an electrode member that is arranged close to, but not abutting, the inner surface of the endless belt in either one of a portion around an exit of the transfer nip on a downstream side of a direction of the endless movement of the endless belt and a portion on an upstream side of the direction of endless movement of the endless belt with respect to the exit of the transfer nip on the downstream side of the direction of endless movement of the endless belt and on the downstream side of the direction of endless movement of the endless belt with respect to a position at which the electric-field generating unit charges the endless belt, to which a voltage of same polarity as the first polarity is applied, wherein the voltage applied to the electrode member is set such that there is no electric discharge between the electrode and the endless belt or a charge amount moved by the electric discharge is equal to or smaller than 10% of a charge amount supplied by the electric-field generating unit.

2. The image forming apparatus according to claim 1, wherein a downstream-side border of the portion within which the electrode is arranged is at about 200 micrometers from the downstream-side exit of the transfer nip.

3. The image forming apparatus according to claim 1, further comprising a charging unit that, before the toner image is formed on the image carrying member, uniformly charges a surface of the image carrying member to a predetermined electric potential of the first polarity, wherein the voltage applied to the electrode is set such that an electric potential of the electrode is smaller than an electric potential of the image carrying member.

4. The image forming apparatus according to claim 1, wherein the electrode is arranged close to the inner surface of the endless belt in the portion on the upstream side of the direction of endless movement of the endless belt with respect to the downstream-side exit of the transfer nip and a second electrode is arranged close to the inner surface of the endless belt in a portion on the downstream side of the direction of endless movement of the endless belt with respect to the downstream-side exit of the transfer nip.

5. The image forming apparatus according to claim 1, wherein the electrode is a substantially circular electrode made of a wire having a cross-sectional diameter of equal to or smaller than 200 micrometers and is arranged perpendicular to the direction of endless movement of the endless belt.

6. The image forming apparatus according to claim 1, wherein the electrode is arranged across the downstream-side exit of the transfer nip.

7. The image forming apparatus according to claim 6, wherein a longitudinal plane of the electrode lies parallel to the inner surface of the endless belt.

8. The image forming apparatus according to claim 7, wherein the electrode is made of a steel plate.

9. The image forming apparatus according to claim 1, wherein the electrode is made of an electrically conductive fabric.

10. The image forming apparatus according to claim 1, wherein the electrode is manufactured by coating a metal film on a surface of an insulating material.

11. The image forming apparatus according to claim 1, wherein at least a surface of the electrode that faces the inner surface of the endless belt is covered with a high-resistance material having a volume resistivity of equal to or larger than $1\times10^{10}$ Ω·cm.

12. The image forming apparatus according to claim 1, wherein at least a surface of the electrode that faces the inner surface of the endless belt has a brush structure.

13. The image forming apparatus according to claim 1, wherein the electric-field generating unit is a corona charging unit.

14. The image forming apparatus according to claim 13, wherein the corona charging unit is a scorotron charging unit.

15. The image forming apparatus according to claim 1, wherein the electric-field generating unit includes a transfer roller that abuts against the inner surface of the endless belt over an abutting portion and a pressure roller that abuts against the transfer roller over a portion that lies along an axial direction of the transfer roller and opposite to the abutting portion of the transfer roller and the endless belt.

16. An image forming apparatus comprising:

an image carrying member that carries a toner image formed with a toner that is charged with an electric charge of a first polarity;

an endless belt that performs an endless movement around a plurality of supporting members and that abuts against the image carrying member to form a transfer nip;

an electric-field generating unit that generates an electric field for transferring the toner image from the image carrying member onto either one of the endless belt and a recording medium conveyed on the endless belt in the transfer nip by charging the endless belt to a second polarity that is opposite to the first polarity while abutting or approaching close to an inner surface of the endless belt; and an electrode member that is arranged close to, but not abutting, the inner surface of the endless belt in either one of a portion around an exit of the transfer nip on a downstream side of a direction of the endless movement of the endless belt and a portion on an upstream side of the direction of endless movement of the endless belt with respect to the exit of the transfer nip on the downstream side of the direction of endless movement of the endless belt and on the downstream side of the direction of endless movement of the endless belt with respect to a position at which the electric-field generating unit charges the endless belt, wherein an electric potential of the electrode has a second polarity that is opposite to the first polarity and is either one of a ground potential and smaller than an electric potential of the endless belt, and the electric potential of the electrode is set such that there is no electric discharge between the electrode and the endless belt or a charge amount moved by the electric discharge is equal to or smaller than 10% of a charge amount supplied by the electric-field generating unit.

17. The image forming apparatus of claim 1, wherein the voltage applied to the electrode member is set so that there is substantially no neutralization of an electric charge of the second polarity on the endless belt.

* * * * *